US005550558A

United States Patent [19]

Salam

[11] Patent Number: 5,550,558

[45] Date of Patent: Aug. 27, 1996

[54] DISPLAY MATRIX

[75] Inventor: Hassan Paddy A. Salam, London, England

[73] Assignee: Unisplay S.A., Geneva, Switzerland

[21] Appl. No.: 118,828

[22] Filed: Sep. 10, 1993

[30] Foreign Application Priority Data

Sep. 11, 1992 [GB] United Kingdom ..... 9219315
Dec. 23, 1992 [GB] United Kingdom ..... 9226760

[51] Int. Cl.[6] ..... G09G 3/34; G09F 9/00

[52] U.S. Cl. ..... 345/111; 340/815.62; 40/449

[58] Field of Search ..... 345/108, 109, 345/110, 111; 340/815.44, 815.53, 815.62, 815.64, 815.8, 815.88, 815.9; 40/449, 492, 466, 450, 451

[56] References Cited

U.S. PATENT DOCUMENTS 4,161,832 7/1979 Bergamini ..... 345/111
4,163,332 8/1979 Salam ..... 40/449
4,328,492 5/1982 Bobak et al. ..... 345/108
4,344,070 8/1982 Forest et al. ..... 345/111
4,779,082 10/1988 Salam ..... 345/111
4,825,205 4/1989 Lee ..... 345/111
4,887,059 12/1989 Asano et al. ..... 335/281
5,148,156 9/1992 Huber et al. ..... 340/815.62

*Primary Examiner*—Richard Hjerpe
*Assistant Examiner*—Kara Farnandez Stoll
*Attorney, Agent, or Firm*—Watson Cole Stevens Davis, P.L.L.C.

[57] ABSTRACT

A back illuminated array of display elements each of which comprises a vane rotatable between two positions by interaction between an electromagnet and a permanent magnet attached to the vane. The electromagnet includes a monolithic member of soft magnetic material having a U-shaped portion and a flange portion end is configured in such a way as to reduce the reluctance of the magnetic circuit comprised by the electromagnet and permanent magnet. The monolithic member can be arranged to provide a bearing for the rotatable vane.

4 Claims, 4 Drawing Sheets

DISPLAY MATRIX

BACKGROUND OF THE INVENTION

This invention relations to matrix displays having an array of display elements of the type in which each display element comprises of a vane arranged to rotate about an axis close to its perimeter between positions of contrasting appearance.

This arrangement therefore provides an array of display elements which may be set in contrasting optical states, for instance "light" and "dark", in order to display information on the display matrix.

PRIOR ART

Displays of this type are described in U.S. Pat. Nos. 4,779,082, 4,163,332 and others. U.S. Pat. No. 4,163,332 discloses display elements which have U-shaped electromagnets having windings which are parallel to the plane of the matrix. The electromagnets interact with permanent magnets on the vanes to cause rotation oh the vanes. U.S. Pat. No. 4,163,332 also discloses display elements having a straight core electromagnet.

SUMMARY OF THE INVENTION

It is an object of this invention to provide an electromagnet for operating display elements of the type described above that has improved sensitivity relative to the previous arrangements so that fewer ampere-turns are required for effective operation. With such improved sensitivity lower cost drive electronics can be used end also a smaller power supply is needed.

In order to achieve this object there is provided a matrix display element comprising:

an opaque planar member having first and second sides and defining an aperture therein;

means on first side of planar member for providing light through aperture;

an opaque vane positioned on second side of planar member arranged to rotate about a hinge axis close to an edge of the vane between a first position in which vane covers aperture and a second position in which vane uncovers aperture;

a permanent magnet mounted on vane member the magnetic axis of which is transverse to the plane of the vane and spaced away from hinge axis;

an electromagnet mounted on said first side of planar member and including a U-shaped body of magnetizable material having first and second limbs, first lamb terminating An a flange extending transverse to the longitudinal axis of first lamb and second limb terminating in a tip portion, electromagnet further including an actuating coil positioned around first lamb;

wherein the electromagnet and the vane are positioned such that permanent magnet is opposite said flange in each of first and second positions such that energization of actuating coil magnetizes flange thereby inducing a drive torque in vane, tip portion being positioned near permanent magnet separated from it by a magnetic air gap and arranged such that magnetization of tip by excitation of actuating coil induces little torque in vane compared with drive torque.

While the magnetic cure of the electromagnet is described, for convenience, as being U-shaped, it will be understood from the following that the basic requirement is that the core member is configured such that the second end of the core, that end not used to provide the magnetic force, is also relatively close to the permanent magnet in order to provide a low reluctance magnetic circuit. This is achieved in two exemplary ways in the two embodiments described below.

Another object of this invention is to provide an electromagnet pole arrangement that includes bearing means for the rotatable vane, and securing means for attaching the electromagnet to the matrix support panel. These additional features save on the cost of manufacturing the matrix panel.

A further object of the invention is provide novel methods of manufacture for display elements of the type discussed above.

Displays of the type with which this invention is concerned are preferably back-illuminated, the vane of each display element being arranged alternately to cover and un-cover an aperture through which light may shine. It is also common for the face of the vane which is revealed when the aperture is on-covered to be reflective.

DESCRIPTION OF PREFERRED EMBODIMENTS

Figure 1:
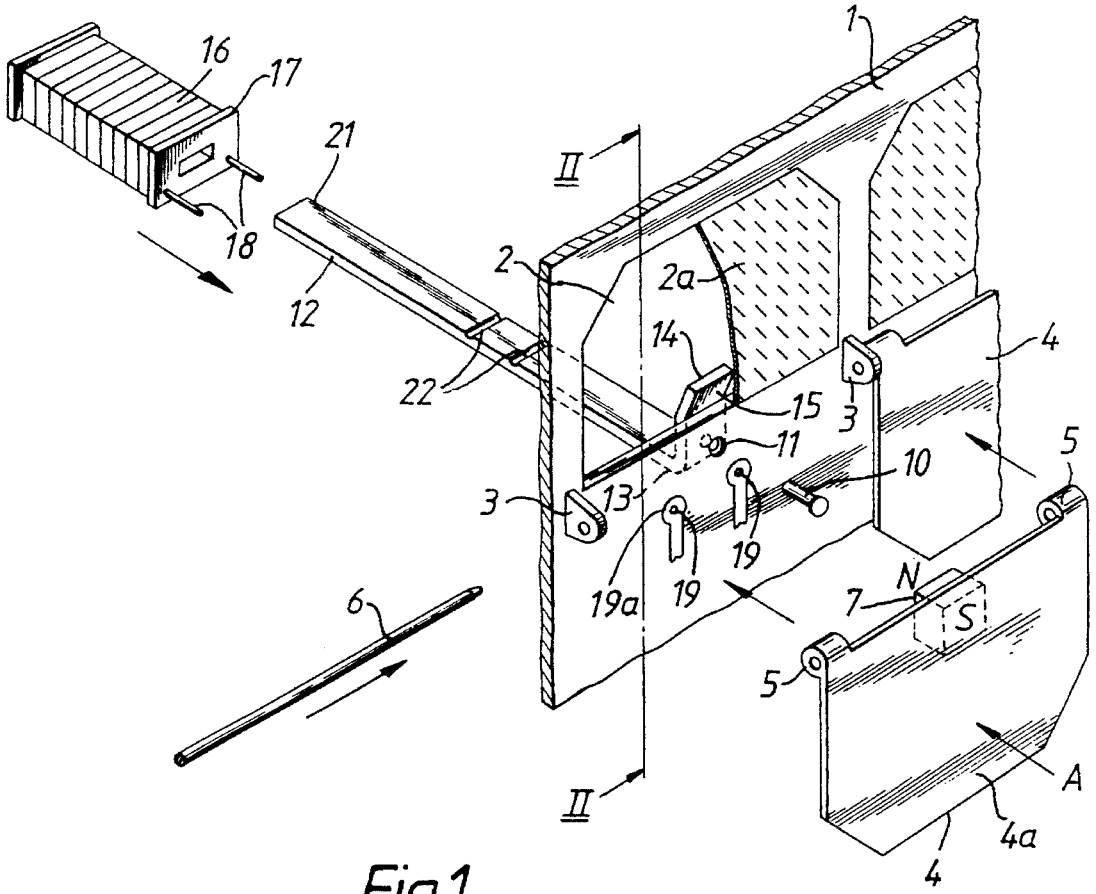
FIG. 1 illustrates the component parts of a display element according to a first embodiment of this invention.

Throughout the figures, the same reference numerals indicated the same or corresponding parts the apparatus described. The construction, assembly and operation of a first embodiment of the invention will be described with reference to FIGS. 1 and 2.

Panel 1 is a printed circuit board which is common to a matrix of display elements only one of which is illustrated. The matrix is designated to be viewed as indicated by arrow A. The display element comprises a light aperture 2 in panel 1 through which light from a source, not shown, behind panel 1 can pass. Within aperture 2 is a diffuser 2*a* shown partly cut away which serves to reflect part of the ambient light on the viewing side of the display. Attached to printed circuit panel 1 are hinge brackets 3 which support rotatable opaque vane 4. Vane 4 is coloured brightly on face 4*a*, shown An FIG. 1, and coloured black on the opposite face, and includes sleeve bearings 5 which nest between brackets 3, which act as side bearings. A horizontal hinge rod 6 is threaded through brackets 3 and sleeve bearings 5. Attached to vane 4 is a permanent magnet 7 shown mounted behind face 4*a*. The magnetic axis of permanent magnet 7 is normal to face 4*a*.

Attached to the rear of panel 1 by means of countersunk rivet 10 passed through countersunk hole 11 in panel 1 is an elongate pole piece 12 of magnetic material bent at elbow 13 to provide a flange 14 on the opposite side of panel 1 to permanent magnet 7. Flange 14 is bent so that its top portion protrudes into aperture 2. This increases the attraction between flange 14 and magnet 7 when the display element is in the dark state, which reduces the risk of its switching to the bright state under the combined influence of shock or vibration and gravity. Flange 14 has a face 15 which is therefore close to but not touching permanent magnet 7. Flange 14 is positioned so that hinge rod is above elbow 13 in the orientation illustrated. Pole piece 12 has two indented grooves 22 extending across its width.

Figure 2:
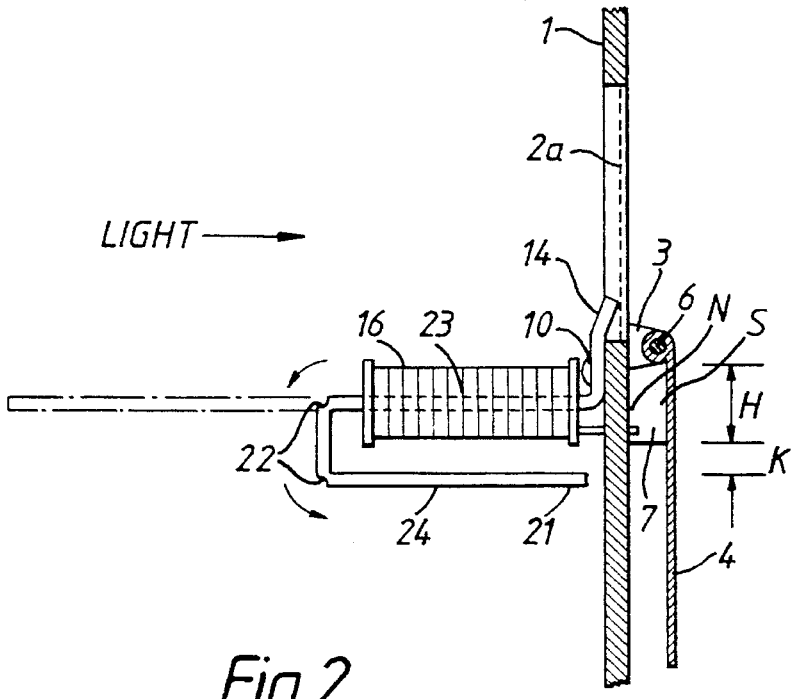
FIG. 2 is a cross sectional side view of the display element shown in FIG. 1 after assembly, taken along section II—II in FIG. 1.

A coil assembly 16, consisting of a coil wound onto a former 17 and comprising two termination pins 18, each in electrical connection with a respective end of the coil winding, is positioned around pole piece 12 as illustrated in FIG. 1. Pins 18 protrude through holes 19 in panel 1 and are soldered to printed circuit pad 19*a* which are concentric with holes 19. Thus printed circuit panel 1 provides electrical connection to coil assembly 16 in addition to providing physical support for the coil assembly 16. To complete the display element, after coil assembly 16 has been positioned around pole piece 12 as described above, pole piece 12 is bent to form a right angle at each of its grooves 22 so that end portion 21 of pole piece 12 is brought close to permanent magnet 7 as shown in FIG. 2. This arrangement provides a law reluctance return path for flux generated by the coil by reducing the reluctance of the magnetic circuit comprised by the electromagnet and permanent magnet 7. Grooves 22, serve to facilitate accurate heading of pole piece 12.

After bending at grooves 22 pole piece 12 is transformed into a magnetic flux guide that consists of a U-shaped portion having lambs 23, 24; with flange forming together with limb 23 an L-shaped portion.

As an alternative assembly procedure, coil assembly 16 may be fitted onto elongate pole piece 12 and pole piece 12 bent to form the right angle at grooves 22 prior to the mounting of pule piece 12 onto panel 1.

A further alternative assembly procedure is to start with a straight strip of magnetic material 12, forming the bends at 22, positioning coil assembly 16 and finally forming bend 13 for flange 14.

All of these alternatives provide the illustrated arrangement.

The display element is operated as follows. When the coil 15 is energized so that flange 14 is a north pole, the north pole of petulant magnet 7 is repelled and the south pole is attracted. This causes vane 4 to pivot to cover aperture 2 with vane 4. When the coil 16 is energized so that flange 14 is a south pole, the south pole of permanent magnet 7 is repealled and the north pole attracted. This causes vane 4 to pivot to expose aperture 2. Pole piece 12 is preferably formed of low cost soft magnetic material such as mild steel, and produced from a continuous narrow coil of the material. Such soft magnetic material, having low remanence and high permeability, requires much fewer ampere turns to produce a given flux than does permanently magnetizble material.

As shown in FIG. 2, end portion 21 of limb 24 is positioned to be below magnet 7 by a distance K when magnet 7 is in the lower of its two positions. K is preferably arranged to be greater than half the magnet height H. This is to ensure that, while there is a low reluctance path from the back of coil assembly 16 to the vicinity of magnet 7, this does not interfere with the provision of a strong operating torque to vane 4 by flange 14 when coil assembly 16 is energized. If the distance K were to be made too small or if tip 21 were to be placed opposite magnet face "N", the operating torque would be reduced, since magnetization of tip 21 by energization of the coil is opposite to that of flange 14. Thus all of the operating torque is provided by the magnetization of flange 14.

The arrangement and assembly described has the advantages that coil assembly 16 is simply fitted to pole piece 12, although pole piece 12 is configured having three folds as shown in FIG. 2, and that the whole electromagnet arrangement lends itself to mounting on and connecting to printed circuit panel 1. As a result of the use of flange 14 as one pole of the electromagnet, substantially the whole of the electromagnet assembly lies below a plane that contains the axis of rotations and that is normal to the plane of panel 1. Only a portion of flange 14 lies above the hinge. This has small area relative to the area of aperture 2 and thus causes very little obstruction to the passage of back light through aperture 2. The net optical result is that the light passing through area 2,2*a* can be very nearly equal to the maximum theoretically possible, namely the area of vane 4, which covers the aperture. Using thin brackets 3, the width of vane 4 can be nearly equal to the centre to centre distance between The electromagnet coil is very close to the permanent magnet 7 that it controls and its magnetic axis is in the same direction as that of magnet 7, contributing to the electrical efficiency of the arrangement.

Flange 14 my either be formed as a single monolithic piece with pole piece 12 or be a separate piece fixed to the end of pole piece 12. In the second alternative the flange piece preferably has similar magnetic characteristics to those of pole piece 12, and further is preferably made of the name material.

Figure 3:
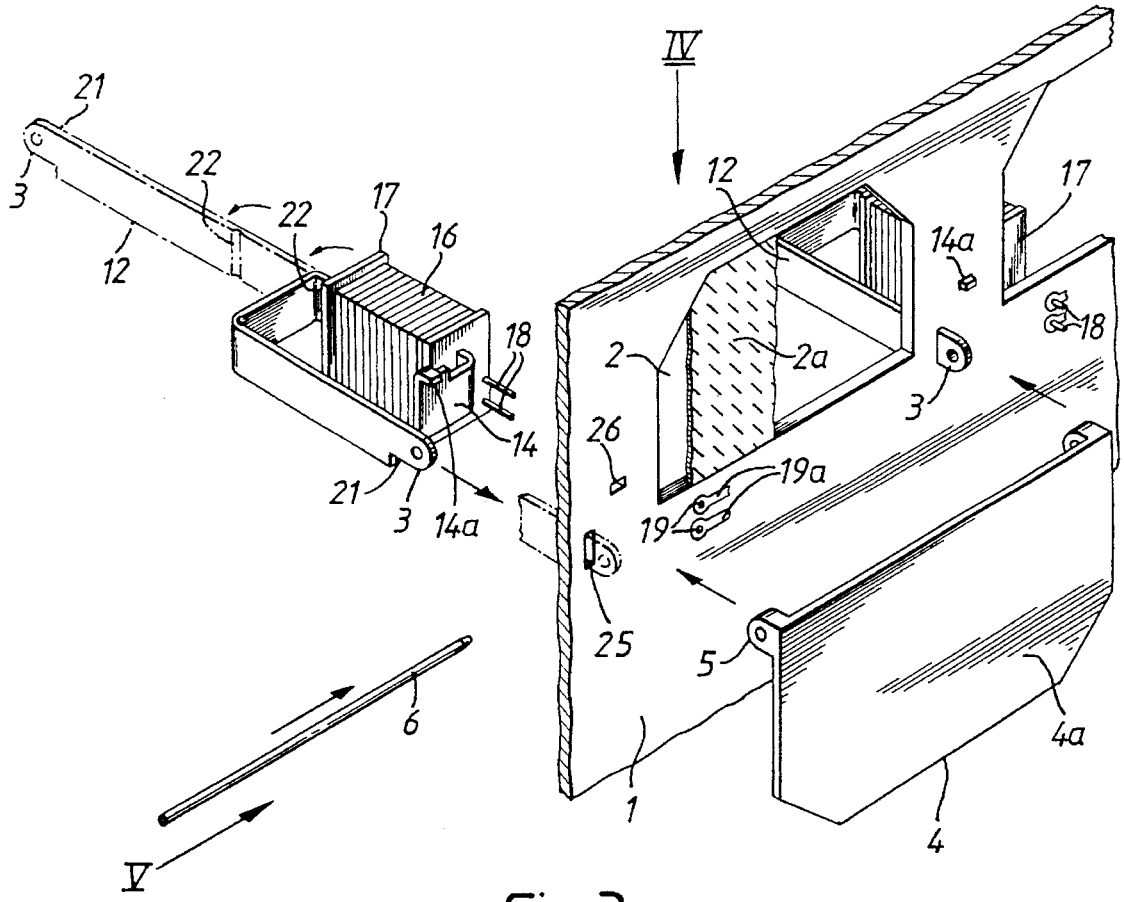
FIG. 3 illustrates the component parts of display element according to a second embodiment of the invention.
Figure 4:
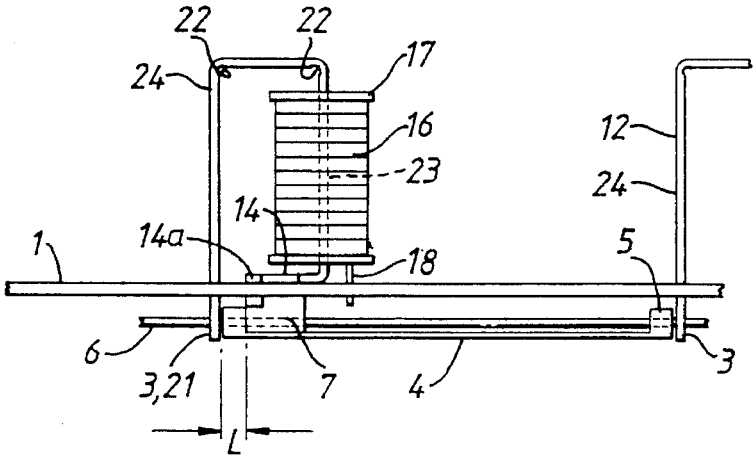
FIG. 4 is a view in the direction indicated by arrow IV in FIG. 3 of the display element according to the second embodiment after assembly.
Figure 5:
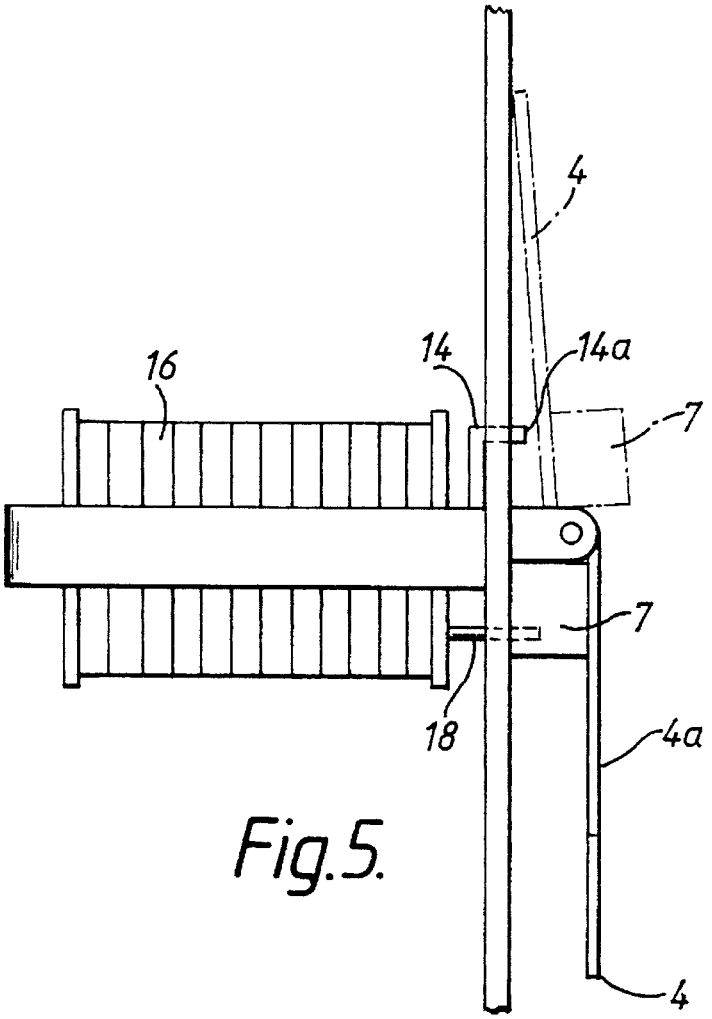
FIG. 5 is a view in the direction indicated by arrow V in FIG. 3 element according to the second embodiment after assembly.

FIGS. 3, 4 and 5 illustrate a second embodiment of the invention. The arrangement is analogous to that of FIGS. 1, 2 and uses the same numbering for features that are the same in both arrangements. The two embodiments differ significantly in the configuration of pole piece 12 and that rivets and individual hinge brackets are dispensed With. In the second embodiment as illustrated in FIGS. 3, 4 and 5 flange 14 has a tab 14*a* projecting towards the front of the matrix. It will be understood from FIG. 3 that the folds in pole piece 12 providing flange 14 and the U-shape are vertical, where as in the first embodiment these folds were horizontal. End portion 21 of pole piece 12 is therefore displaced sideways from flange 14, not vertically, and is formed to provide side bracket 3 as an integral part of pole piece 12. Thus the hinge brackets 3 of the first embodiment are dispensed with. Pole piece 12 is preferably of magnetic material of low remanence and high permeability.

After coil assembly 16 has been fitted onto pole piece 12 and pole piece 12 has been bent at grooves 22 in a similar manner to the assembly of the first embodiment, bracket portion 3 and tab 14*a* are fitted into holes 25, 26 respectively in panel 1. Holes 25, 26 are arranged so that the fits are force fits, i.e., tight fits whereby to secure folded pole piece 12 permanently to panel 1. Thus the electromagnet assembly is mounted without requiring further fixing eg. by a rivet. Tab 14*a* and bracket 3 may be suitably tapered in shape to facilitate fitting. Pole piece 12 is further supported by coil assembly 17 which is soldered to printed circuit panel 1 by way of pins 18 and holes 19 in similar manner to that described in relation to the first embodiment.

The operation of the display element of FIGS. 3–5 is the same as the operation of the display elements of FIGS., 1 and 2 and is by way of energizing coil 16 and the interaction between the electromagnet and permanent magnet 7.

In the second embodiment, the length L of the magnetic air gap between magnet 7 and pole piece bracket portion 3 is independent of the rotational position of magnet 7. This relatively small air gap provides a low reluctance path for flux that is generated by coil assembly 16. The flux generated by energizing coil assembly 16 passes through flange 14 to magnet 7 and from the side of magnet 7 to hinge bracket 3, and so via limb 24 back to the core 23 of the coil.

When coal assembly 16 is energized the direction of the resultant force Between magnet 7 and hinge bracket 3 is substantially parallel to the plane of vane 4. This force has a negligible component acting to rotate vane 4 and therefore does not interfere with the operating torque generated by electromagnetisation of flange 14.

Therefore both described embodiments of the invention provide a low reluctance path for the magnetic flux generated by coil 15. This improves the efficiency of the energy transfer from the electric supply of coil 16 to the moving of vane 4, and hence fewer ampere-turns are required to switch the state of the display element. It will be understood then that for a given coil, a lower current is required to activate the display element than is required in previously known arrangements not configured to provide the low reluctance path. Alternatively a coil having fewer turns can successfully be used In the present invention using the same current as in the above mentioned known arrangements.

It will further be understood that the above mentioned improvement in the energy transfer means that there is a reduction in the power required to be supplied to the electromagnetic order to effect a change of state of the display element.

Figure 6:
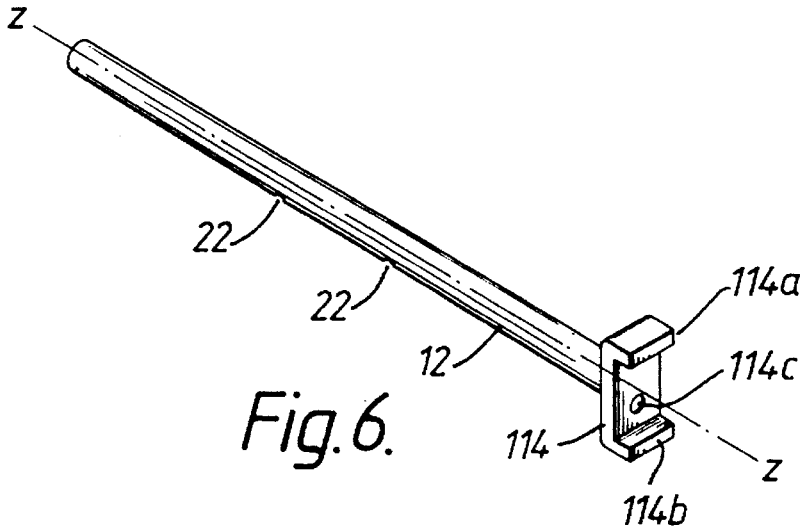
FIGS. 6 and 7 illustrate another arrangement for the electromagnet pole piece according to invention.
Figure 7:
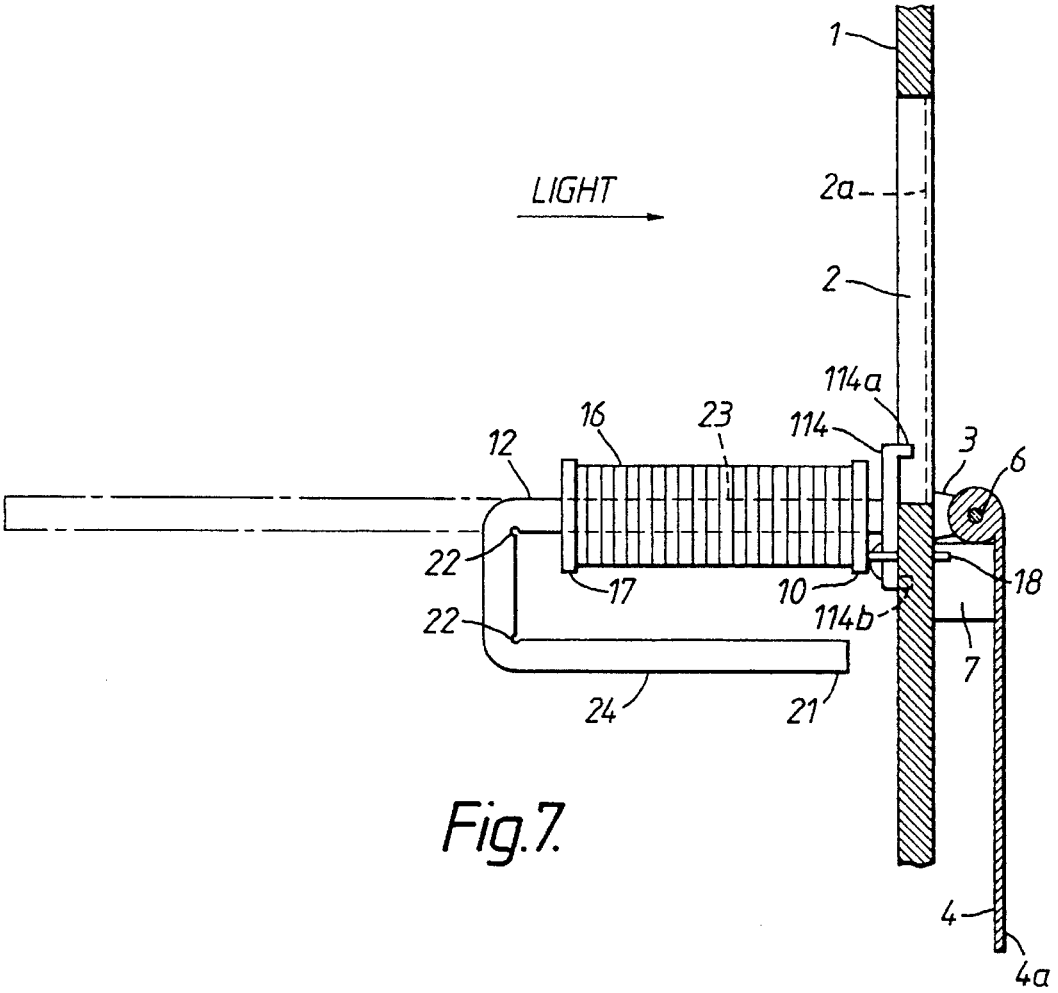

FIGS. 6,7 illustrate another arrangement for the electromagnet pole piece according to the invention. In this case the shank of pole piece 12 is of rod or wire, which is bent at notches 22 after the coil is fitted onto the shank. Flange 114 forms a T-shape with the shank-Flange 114 includes a portion 114*a* that is above central axis Z-Z of the shank. Portion 114*a* protrudes into aperture 2 in panel 1 and is close to magnet 7 when vane 4 covers aperture 2. Flange 114 also includes a portion 114*b* that is below central axis Z-Z of the shank. Portion 114*b* protrudes into matrix panel 1 and is close to magnet 7 when vane 4 is in the downward position, exposing aperture 2. Pole piece 12 may be attached to panel 1 by a rivet 10 passing through hole 114*c* in T-flange 114, the rivet being countersunk into panel 1 and entered from the vane side of panel 1.

The obstruction to light passing through aperture 2 presented by flange 114 is small relative to the total area of aperture 2, as is the obstruction caused by coil assembly 16. The T-shaped end of pole piece 12 can be shaped by cold fuming.

Figure 8:
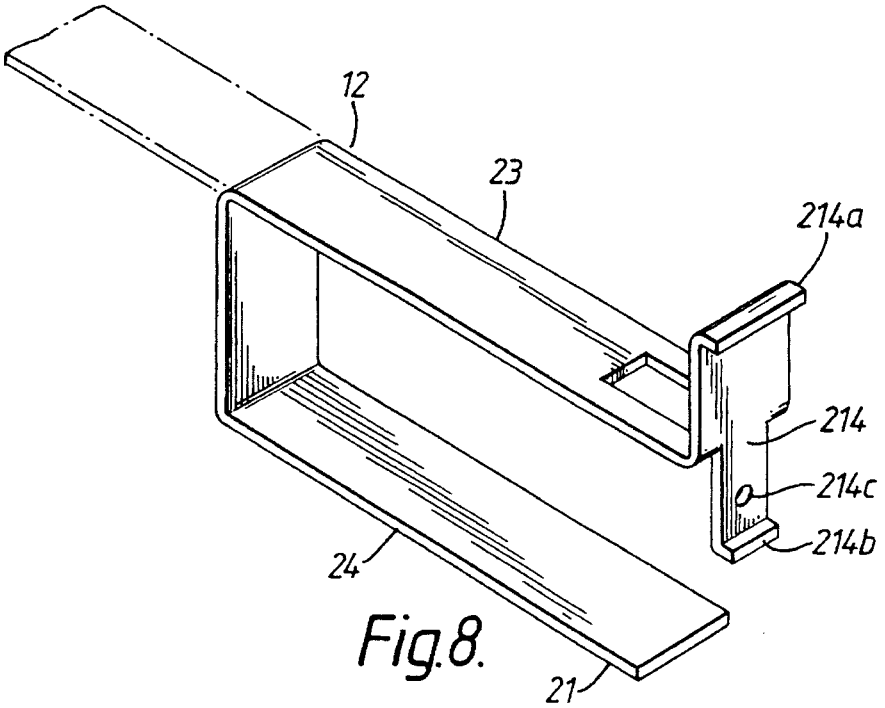
FIG. 8 illustrates yet another electromagnetic pole piece according to this invention.

FIG. 8 illustrates yet another form for a folded electromagnet pole piece according to the invention. The coil, fitted before folding the into a U-shape, is not shorn. The part is made from strip material, the bottom half of T-shaped flange 214 as well as the top half being pressed out of strip stock.

In all embodiments hinge rod 6 is preferably of non-magnetic material. This is to ensure that flux from flange 14 is directed to magnet 7 as far as possible. If rod 6 were to be made of magnetic material, some of the electromagnetically generated flux emanating from flange 14 would be shunted into and along rod 6 instead of reaching magnet 7, and so the operating torque would be weakened.

I claim:

1. A matrix display element comprising:

an opaque planar member having first and second sides and defining an aperture therein;

a translucent diffuser mounted close to said aperture having front and back faces;

means on said first side of said planar member for providing light impinging on the back face of said diffuser;

an opaque vane having first and second faces of differing color arranged to rotate about a hinge axis close to an edge of the vane between a first position in which said vane covers said aperture and exposes to a viewer on the second side of the planar member its first face and a second position in which said vane uncovers said aperture and exposes to the viewer its second face;

a permanent magnet mounted on said vane, the magnetic axis of said permanent magnet being transverse to the plane of the vane and the center of which is spaced from said hinge axis;

further comprising an electromagnet on said first side of said planar member comprising an actuating coil and a U-shaped body of magnetizable material having first and second limbs, said first limb being coaxial with said coil and connected to a magnetic member extending away from said first limb in a direction transverse to the longitudinal axis of said first limb, at least part of said magnetic member being positioned next to said permanent magnet for magnetically interacting therewith, said second limb terminating in a tip portion spaced from said magnet by a magnetic air gap having a length which is parallel to said hinge axis and constant for all rotational positions of said vane.

2. A matrix display element comprising:

an opaque member having first and second sides and defining an aperture therein;

a translucent diffuser mounted close to said aperture having front and back faces;

means on said first side of said opaque member for providing light impinging on the back face of said diffuser;

an opaque vane having first and second faces of differing color arranged to rotate about a hinge axis close to an edge of the vane between a first position in which said vane covers said aperture and exposes to a viewer on the second side of the opaque member its first face and a second position in which said vane uncovers said aperture and exposes to the viewer its second face;

a permanent magnet mounted on said vane, the magnetic axis of said permanent magnet being transverse to the plane of the vane and the center of which is spaced away from said hinge axis;

further comprising an electromagnet on said first side of said opaque member comprising an actuating coil and a U-shaped body of magnetizable material of low magnetic remanence having first and second limbs, said first limb being coaxial with said coil and connected to a magnetic member extending transverse to the longitudinal axis of said first limb positioned next to said permanent magnet for magnetically interacting therewith, said second limb terminating in a tip portion spaced away from said magnet for each of said positions by a magnetic air gap, excitation of said coil inducing in said magnet by interaction between said magnetic member and said magnet a first torque and by interaction between said tip portion and said magnet a second torque, said second torque being less than and opposite to said first torque.

3. A matrix display element as in claim 2, wherein said magnetic member comprises a first part extending from said first limb in a direction normal to the axis of said first limb and a second part extending from said first part into said aperture.

4. A matrix display element comprising:

a planar opaque member having first and second sides and defining an aperture therein;

a translucent diffuser mounted close to said aperture having front and back faces;

means on said first side of said opaque member for providing light impinging on the back face of said diffuser;

an opaque vane having first and second faces of differing color arranged to rotate about a hinge axis close to an edge of the vane between a first position in which said vane covers said aperture and exposes to the viewer its first face and a second position in which said vane uncovers said aperture and exposes to the viewer its second face;

a permanent magnet mounted on said vane the magnetic axis of which is transverse to the plane of the vane and the center of which is spaced away from said hinge axis; and an electromagnet on said first side of axis opaque member comprising an actuating coil having an axis which is normal to the plane of said planar member and a body of magnetized material, said body comprising a straight part coaxial with said coil having first and second ends, a first magnetic member at said first end integral with said straight part extending transverse to the longitudinal axis of said straight part and positioned next to said permanent magnetic for magnetically interacting therewith, and a second magnetic member emanating from said second end in a direction transverse to the longitudinal axis of said straight part, said straight part and said second member being one continuous bent piece of material of low magnetic remanence.

* * * * *